US005603270A

United States Patent [19]

White et al.

[11] Patent Number: 5,603,270

[45] Date of Patent: Feb. 18, 1997

[54] QUILTING MATERIAL HANDLING AND FEEDING METHOD AND APPARATUS

[75] Inventors: M. Burl White, Coral Springs; John Keys, Hallandale; Roland Bulnes, Margate; James T. Frazer, Coral Springs, all of Fla.

[73] Assignee: L&P Property Management Company, Chicago, Ill.

[21] Appl. No.: 441,607

[22] Filed: May 15, 1995

[51] Int. Cl.[6] ..... D05B 11/00

[52] U.S. Cl. ..... 112/117; 112/475.07; 112/475.08

[58] Field of Search ..... 112/117, 118, 112/119, 470.01, 470.06, 470.14, 475.07, 475.08, 307, 163, 165, 166, 167, 292, 475.05

[56] References Cited

U.S. PATENT DOCUMENTS

| | | | |
|---|---|---|---|
| 4,815,404 | 3/1989 | Young, Jr. | 112/307 |
| 5,027,726 | 7/1991 | Brower et al. | 112/117 |
| 5,154,130 | 10/1992 | Gribetz et al. | 112/292 |

*Primary Examiner*—Peter Nerbun
*Attorney, Agent, or Firm*—Wood, Herron & Evans, P.L.L.

[57] ABSTRACT

A quilting method and apparatus in which ticking or facing material changes are effected, preferably under the control of a programmed computer or controller, by automatically retrieving, and preferably also splicing onto a web, selected materials from a facing material supply. The controller preferably also controls a quilter in the stitching of selected patterns along a web, and coordinates the positions of the patterns and material splices between the patterns, in response to measurements and calculations of dimensional changes between infeed webs, quilted tensioned web and cut untensioned panels. Storage compartments are provided for a variety of facing materials, preferably rolls thereof. A retrieval mechanism moves webs selected by the programmed controller to a feed position adjacent the quilter. Preferably, the storage compartments are moveable and suspended from an endless conveyor, and the retrieval mechanism also includes a two holder transfer arm that can exchange webs between the conveyor and a quilter feed position. In a fully automated embodiment, the transfer arm includes V-shaped troughs formed of moveable belts that unwind and rewind the ticking supply rolls.

33 Claims, 6 Drawing Sheets

33 FIG. 2

QUILTING MATERIAL HANDLING AND FEEDING METHOD AND APPARATUS

The present invention relates to automatic quilting and, more particularly, to the formation of series of quilted panels of different patterns or different materials along a web.

BACKGROUND OF THE INVENTION

Mattress manufacture typically employs the covering of a resilient spring interior with a fabric cover that provides much of the comfort and the appearance of the mattress product. Such fabric covers are commonly made of quilted material formed by stitching patterns on multiple layered fabrics formed of a layer of backing material, one or more layers of thick filler material and an outer layer of facing material or ticking. Such quilted fabric or quilts are most often formed on multiple needle sewing machines that stitch the layers of material together with stitched patterns that provide both the functional joining of the material that forms the quilted mattress cover and contributes to the ornamental features of the mattress product. Such machines include, for example, that illustrated and described in the commonly assigned U.S. Pat. No. 5,154,130 of Gribetz et al. entitled Multi-Needle Double Lock Chain Stitch Tack, Jump and Thread Trimming Quilting Method and Apparatus, expressly incorporated herein by reference into the description of the drawings below. Such quilting machines sequentially form such quilts by the cooperative motion of ganged arrays of needles and loopers forming chain stitched patterns on a multiple layered fabric web.

Mattress manufacturers produce products that cover wide ranges of price and quality. The price and quality of mattresses are affected by the quality of the spring interior and by the quality of the cover. The cover quality is determined in part by the quality and thickness of the material layers as well as the nature of the quilting process employed. Marketing methods as well as the demands of the mattress market have resulted in a trend toward increased variety in the mattress covers made available to retailers and consumers, particularly in the premium mattress product lines. Such variety is provided by the production of mattress covers utilizing stitched patterns of a wide variety as well as employing a wide variety in the ticking used. This trend, coupled with a general trend in merchandizing toward building products to individual retailer orders rather than to the stocking of inventories, has caused manufactures of mattresses to produce their products on a small order basis, sometimes changing the designs of products, including pattern design and ticking material, after the production of only a small number of, for example every three to ten, products.

The frequent changing of quilting patterns has been provided by quilting machines, such as that of U.S. Pat. No. 5,154,130, by stitching the patterns under the control of a programmed controller, which has the capability of automatically changing patterns from one quilted item to the next, with or without the manual changing of the arrangements of needles in a needle array. For frequent changes in ticking, however, the cutting of the ticking between a supply roll and the quilter is required, then the replacement of the ticking roll with a new roll and the splicing of the ticking from the new roll to either the trailing edge of the cut-off ticking, or to the underlying layers of filler or backing material that make up the fabric web. A typical mattress manufacturer will interchange daily from tens of rolls of ticking or facing material of differing types to up to a hundred or more rolls, particularly where premium quality mattress orders are being produced. Such rolls can contain webs that are over ninety inches wide and may be a hundred yards long or longer. Such rolls are heavy and difficult to handle. The roll changing results in substantial manual setup time, which contributes considerably to quilting machine down time that approaches or exceeds sixty or seventy percent in the industry. Thus there is a need for improvement in the making of material changes in web quilting processes, particularly to increase the speed with which ticking changes can be implemented in mattress cover quilting manufacture.

SUMMARY OF THE INVENTION

A primary objective of the present invention is to provide high efficiency use of web fed quilting machines, and particularly to facilitate rapid changes of the ticking or facing materials.

It is a more particular objective of the present invention to provide for programmed control and batch processing of quilts having a variety of designs, particularly with changes in facing material from design to design. It is a particular objective of the invention, to expedite the facing material changes when quilting upon webs, particularly where the number of similar quilt designs or batches are small, and where more frequent changes in the material fed to the quilter are required.

It is a further objective of the present invention to provide partially or fully automated control of facing material changes when quilting upon webs, including particularly the automating of the storage, retrieval and splicing of rolls of facing material to such webs.

In accordance with the principles of the present invention, a quilting machine, particularly a machine of a web type, is provided with a multiple compartment storage system in which a plurality of web supplies, usually in roll form, of facing material are stored. The machine is provided with a retrieval system by which individual rolls of ticking or facing material are selectively retrieved from the storage system and presented in a position for feeding to the quilting station of the quilting machine, and also preferably splicing the new selected roll to the web.

In accordance with the preferred embodiment of the invention, the retrieval system includes the provision of moveable compartments in the storage system. In the preferred embodiment, such compartments are provided in the form of roll supporting bins suspended on a conveyor, and are moveable into position either for the feeding of facing material directly therefrom to the quilter or for transferring the retrieved facing material web to a feeding station. Particularly, in accordance with the preferred embodiment, there is provided a multiple holder transfer mechanism with which a roll of material can be received from and held in a standby position while another web of facing material is being held and fed into the quilting station. With such transfer mechanism, when a change in facing material is required, the web that was being fed to the quilting station is cut therefrom and is exchanged with the web in the standby position, which is then spliced onto the multi-layered web.

In one embodiment of the invention, the storage unit is provided with a plurality of bin type compartments on an endless conveyor. The conveyor is indexed to a transfer position in response to signals from a controller. From such transfer position, the roll is then transferred to a bin on an arm of the transfer mechanism. The arm is pivoted to bring the selected roll to a feed position while a roll in another bin on the arm of the transfer mechanism is pivoted away from the feed position toward the conveyor and is transferred therefrom back to a storage compartment or bin on the conveyor. Preferably, the conveyor has one transfer position above the transfer mechanism, from which a roll can be dropped by a tipping of the bin into a bin on the transfer arm, and a second transfer position below the transfer mechanism, into which the previously used roll can be dropped by a tipping of the bin on the transfer arm.

In another alternative of the invention, the bins on the transfer mechanism are in the form of V-shaped belt lined cradles which operate to unroll and rewind the rolls at a feeding position, to and from a splicing station, to provide for fully automatic roll retrieval and splicing without a need for the operator to perform manual steps of the retrieval on splicing process.

The embodiments of the invention include a programmed computer control device, which contains a program for affecting the quilting of a selected one of a plurality of patterns onto the web at the quilting station, and which controls the selection of the facing material, including the operation of the storage retrieval, transfer mechanism and splicing mechanism. Particularly, the control accepts data or operator commands, preferably which specify the pattern choices and facing material selections for a plurality of batches or orders of quilts to be manufactured by the quilting machine. The controller sends signals to the quilter and facing material supply to affect and coordinate of facing material exchange and the change of patterns as are called for by the controller to fill the orders and to manufacture the quilts in accordance with the data input to the controller. The controller preferably further includes logic that coordinates information from a panel cutter downstream of the quilting station with information from the quilter and from the feeding of the web throughout the machine, and that calculates and predicts the shortening of the web due to the gathering of the material in the quilting operation and the relaxation of the tension on the web as the panels are cut therefrom. Such information is used by the controller to calculate, within a requisite precision of, for example, a few inches, the locations of facing material splices to be made upstream of the quilting station.

With the present invention, the overall productivity of a quilting machine is increased, particularly where it is desirable to produce a wide variety of quilted products in relatively small quantities for each type of product. Facing material changes are automatically made with little interruption of the feeding of the multi-layered web into the machine, and with little or no operator intervention or manual steps. The changing of ticking or facing material on the quilts is automatically coordinated with the automated pattern control of the quilts of each batch or order. Splice points for the ticking changes are precisely determined, taking into account the shrinkage that affects the web length needed to produce the final panel dimensions, thereby substantially reducing material waste.

These and other objectives and advantages of the present invention will be more readily apparent from the following detailed description of the drawings of the preferred embodiment of the invention, in which:

DETAILED DESCRIPTION OF THE DRAWINGS

Figure 1:
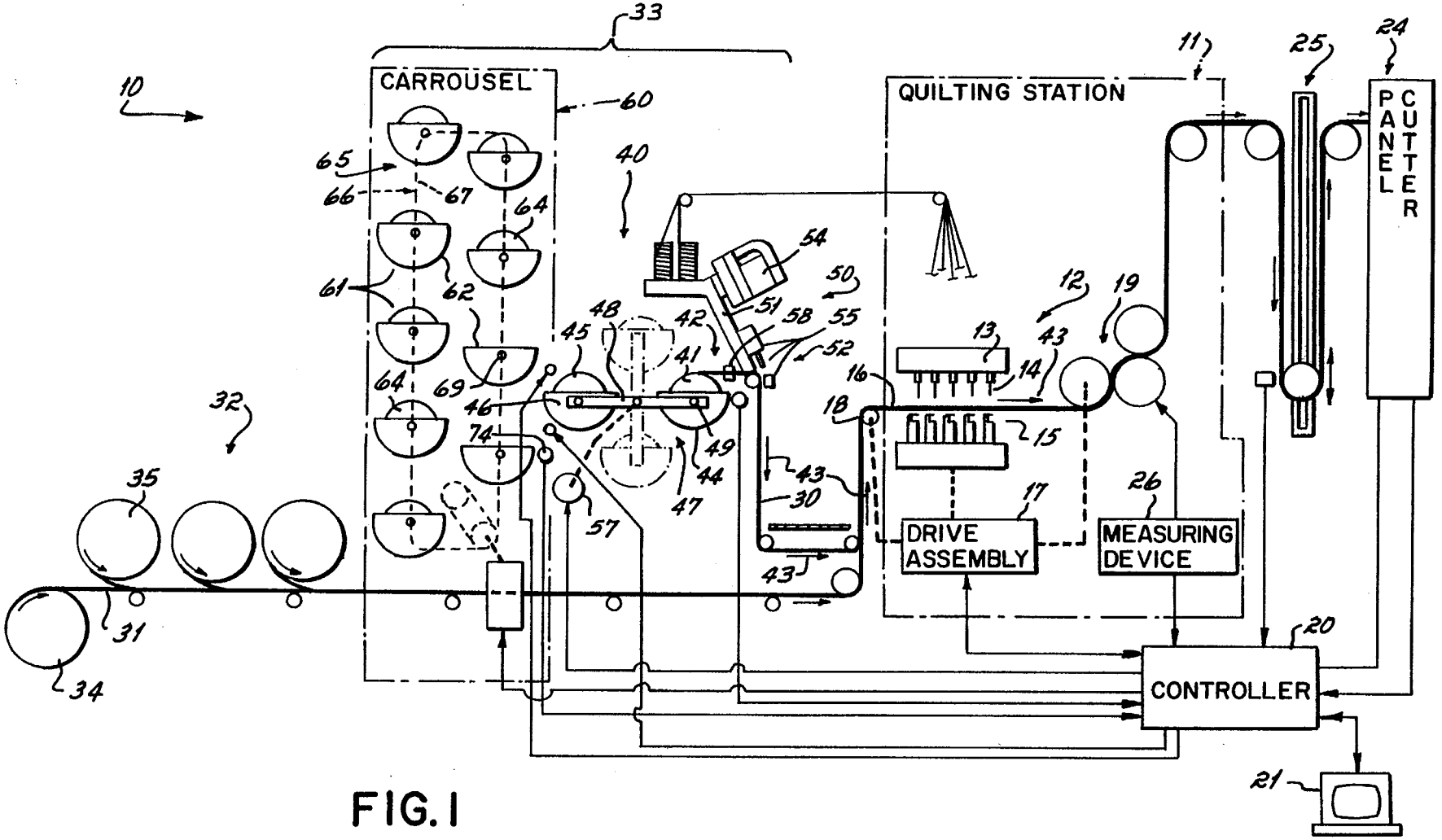
FIG. 1 is an elevational diagram of one embodiment of a quilting machine according to principles of the present invention.

Referring to FIG. 1, a quilting machine 10 is illustrated, which includes a quilting station 11 at which is preferably located a multi-needle quilter 12 of the type described in commonly assigned U.S. Pat. No. 5,154,130 of Gribetz et al. entitled Multi-Needle Double Lock Chain Stitch Tack, Jump and Thread Trimming Quilting Method and Apparatus, hereby expressly incorporated by reference herein. The quilter 12 includes a stitching mechanism 13 formed of a ganged array of needles 14, a corresponding ganged array of loopers 15 positioned on the opposite side of a fabric web 16 from the needles 14, and a drive assembly 17, which coordinates the motion of the needles 14 and loopers 15 with the movement of feed roller sets 18 and 19 to stitch double lock chain stitch patterns on the web 16.

More particularly, the drive assembly 17 cycles the needles 14 and loopers 15 such that the stitching mechanism 13 forms a plurality of sequences of stitches in the fabric web 16, one stitch with each operating cycle of the stitching mechanism 13, to form an array of patterns on the web 16. In addition, the drive assembly 17 synchronizes the formation of the stitches by the mechanism 13 with the forward feed of the web 16, as well as with a transverse motion of the stitching mechanism 13 relative to the web 15. This synchronized motion controls the lengths of stitches formed by the mechanism 13 and determines the pattern formed by the stitching mechanism 13 upon the web 16. With the quilter 12 of the Gribetz type disclosed in the patent identified above, the rolls 18 and 19 are capable of being driven bidirectionally by the drive assembly 17, so that each of the pairs of needles 14 and loopers 15 will be capable of forming discrete patterns upon the web. Such a machine also trims treads to the needles to separate discrete patterns of pattern arrays. Such patterns might be specific to particular orders of quilts to be made, and be produced by the operation of the drive mechanism 17 in response to signals from a programmed controller 20.

For the quilts or batch of quilts of an order or series of orders for, for example, quilted mattress covers, the patterns produced by the quilting mechanism 13 under the control of the controller 20 may differ. The program of the controller 20, in response to data input to the controller 20 by an operator or interface computer 21, coordinates the production of the batches of quilts according to a series of orders input in the form of the data.

The series of quilts that are sewn at the quilting station 11 upon the fabric web 16 proceeds downstream from the quilting station 11 to a panel cutter 24, which cuts each of the quilts that have been sewn from the web 16. The panel cutter 24 is also controlled by the programmed controller 20 to synchronize longitudinal positions of transverse cuts made along the web 16 by the panel cutter 24 so that the cuts lie between the stitched areas on the web 16 that define the patterned quilts, Preferably, the panel cutter 24, as well as its interrelation to the controller 20 and the controlled operation of the quilter 12, are as described in the commonly assigned and copending U.S. patent application of Frazer et al., Ser. No. 08/271,420, filed Jul. 6, 1994, entitled Program Controlled Quilter and Panel Cutter System with Automatic Shrinkage Compensation, hereby expressly incorporated by reference herein. With such a preferred panel cutter and quilter system, the panel cutter 24 is provided with an accumulator 25 located between it and the quilting station 11, as well as a measuring device 26, such as a rotary optical encoder. The panel cutter 24, accumulator 25 and measuring device 26 all provide web length measurement information to the controller 20, which is coordinated by the controller 20 with feedback signals from the drive assembly 17, to precisely determine the relationship of the finished quilt length or panel at the panel cutter 24 to the length of a corresponding amount of the fabric web 16 at both the upstream and downstream sides of the quilter 12, In this way, not only are the panels cut precisely between the quilted patterns at the panel cutter 24, but the locations of the individual patterned quilts along the web of fabric 16 can be predicted and located upstream of the quilting station 11. This provides information that can be used by additional programmed routines of the controller 20 to control the web supply upstream of the quilting station 11.

The web of fabric 16 of which the quilts are made is typically formed of a plurality of layers of material that include a layer of facing material 30, such as a ticking material that forms the outer covering of a mattress, and an underlying filler and backing material 31, formed of one or more layers. The facing material 30 and the backing and filler material 31 are supplied in web form and brought together at the front of the quilting station 11 at the feed rolls 18, where they then become the multi-layered web 16. The feed rolls 18 feed the multi-layered web 16 into the quilter 12 and pull the individual webs of material 30 and 31 from their supplies, which include a filler and backing material supply 32 and a facing material supply 33.

The backing and filler material supply 32 typically includes separate rolled web supplies, including a backing material supply roll 34 and one or more rolls 35 of filler material of one or more types. The filler material rolls 35 carry the thick resilient inner filling of the quilts, while the backing material roll 34 provides the more structurally stable inner layer or cover that isolates the filler material from the spring interiors of the mattresses. In some applications, the filler and backing materials may be provided in a preformed single composite layer. In the illustrated embodiment of FIG. 1, the backing material from the roll 34 presents a web flight that extends from the roll 34 to the quilting station 11 and forms a carrier that transports the fluffy filler material from the rolls 35 to the quilting station. Otherwise the filler material might have a tendency to droop or to permanently stretch, and often does not readily support the tension needed to pull the filler from the rolls 35.

The supply 33 of facing material or ticking includes an infeed station 40 at which a supply roll 41 of ticking or facing material is supported at a feed position 42 from which web 30 thereof can be fed into the quilting station 11. The web 30 extends from the roll 41 along a path 43, represented by the arrows so numbered in FIG. 1, to the feed rolls 18 on the upstream side of the quilter 12. In the embodiment illustrated in FIG. 1, the supply roll 41 is supported in the feed position 42 at the infeed station 40 in a semi-cylindrical trough, bin or cradle 44, which has an interior surface having a sufficiently low coefficient of friction between the cradle 44 and the roll 41 to facilitate the pulling of the web 30 from the roll 41 by the feed rolls 18. This friction is, however, high enough to provide some tension on the web.

Figure 2:
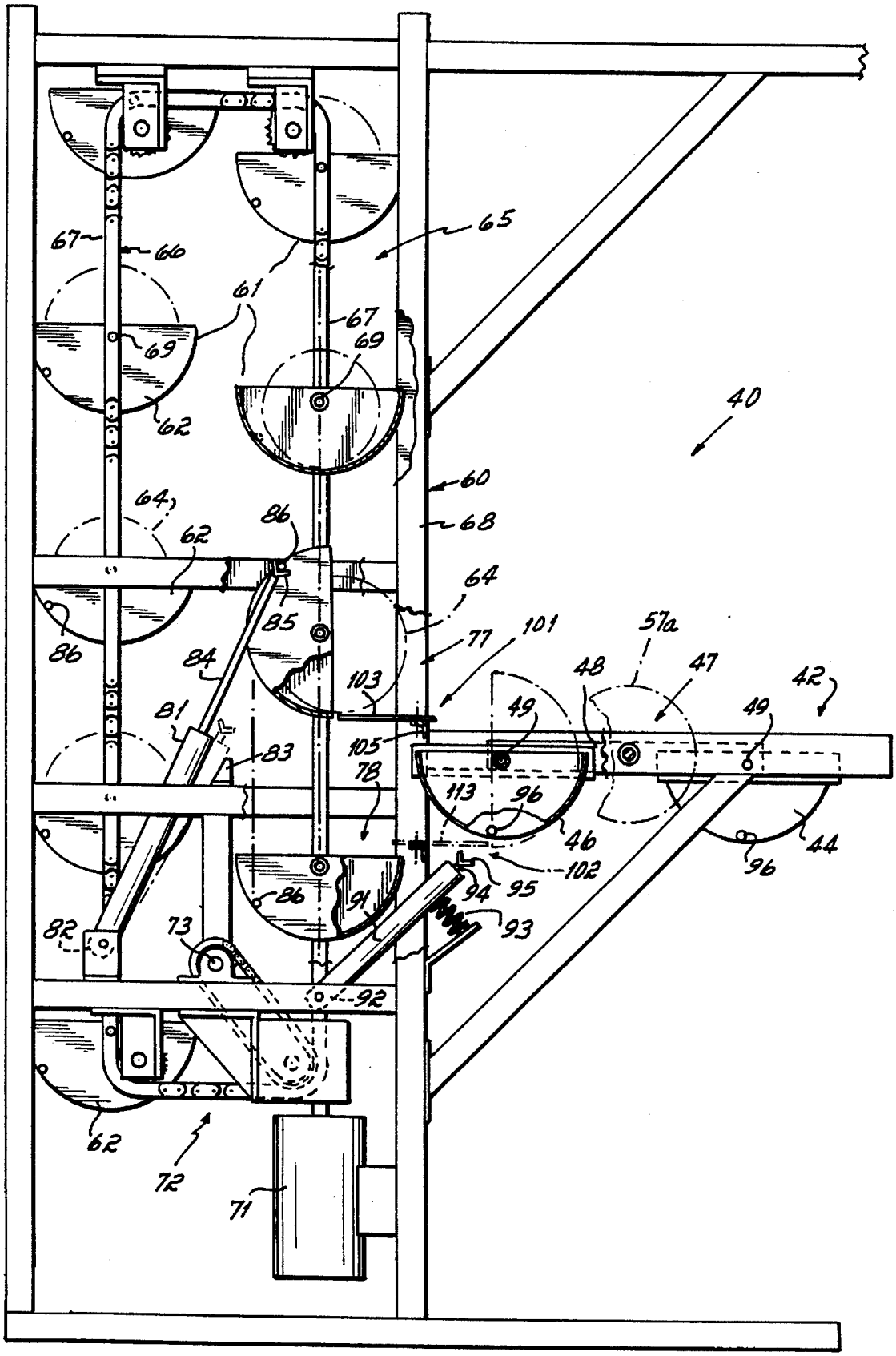
FIG. 2 is an elevational view of the facing material supply of the embodiment of FIG. 1.

In the course of manufacturing quilts in accordance with programmed batches or orders, the ticking or facing material is frequently changed from one quilt to another along the web of fabric 16, This involves the replacement of one roll of facing material, for example roll 41, with another standby roll, for example, roll 45. To facilitate such a roll change, a further bin or cradle 46 is provided to support the standby roll 45. The cradles 44 and 46 are part of a transfer mechanism 47 and are on the opposite ends of an H-shaped transfer arm 48 to which the bins 44 and 46 are pivotally supported on shafts 49 at their opposite sides, as illustrated in FIG. 2. The bins 44 and 46, whether empty or containing rolls 41 and 45, respectively, normally assume the upright positions shown in FIG. 1 because the weight of the bins and rolls is centered below the shafts 49. The bin 46, like the bin 44, has a moderately polished inside surface so that it can be exchanged with the bin 44 at the feed position 42, upon the 180° rotation of the arm 48, at which it can support the next roll 45 so that a web can be pulled therefrom by the feed rolls 18.

In order for the rolls 45 and 41 to be exchanged at the feed position 42 at the infeed station 40, the web 30 extending from the roll 41 must first be cut from the portion thereof extending through the quilting station 11 and the leading edge from the roll 45 must then be sewn or otherwise attached to the fabric web 16. This is achieved by the provision of a splicing station 50 along the path 43, as is more particularly illustrated in FIG. 3.

Figure 3:
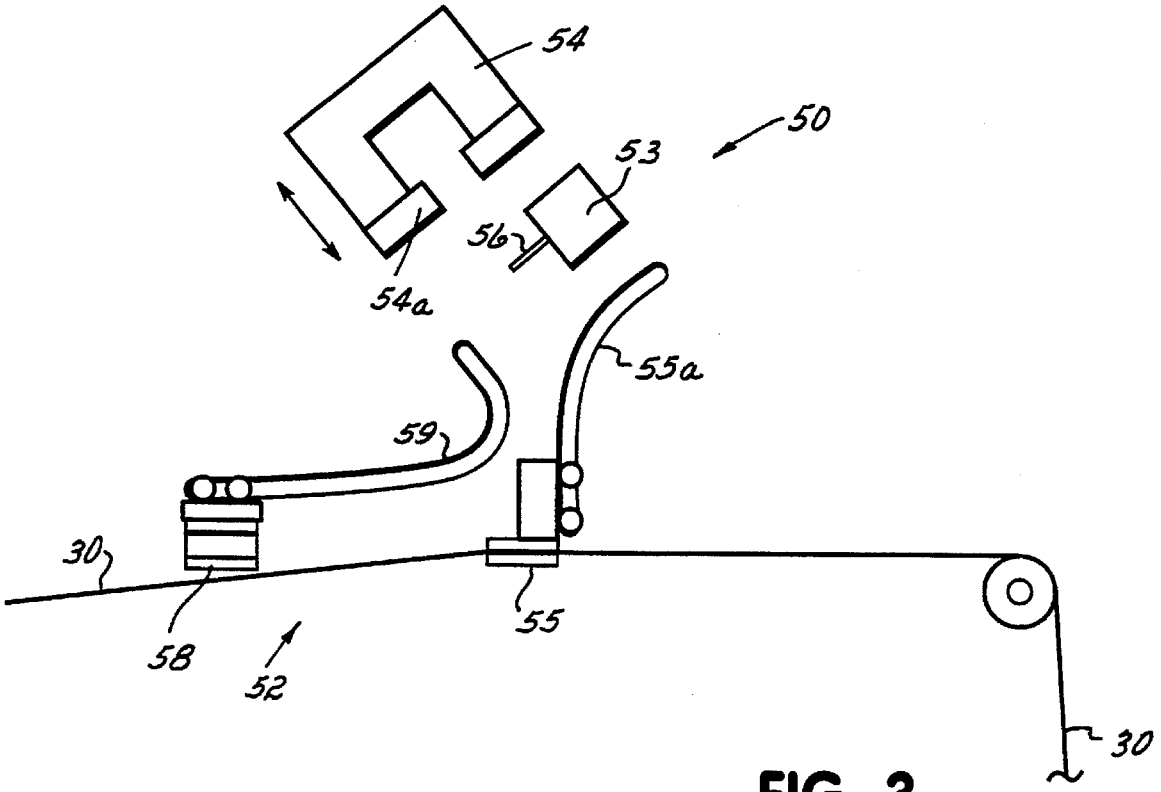
FIG. 3 is an elevational diagram schematically illustrating the splicing station of the embodiment of FIG. 1.

In FIG. 3, a splicing station 50 is illustrated downstream of the infeed station along the path 43 and includes a clamp mechanism 52, a cut-off mechanism 53, and an attaching mechanism 54. The clamp mechanism 52, cut-off mechanism 53 and attaching mechanism 54 are mounted along the path 43 at the upstream of the quilting station 11 on a frame that may be a part of the top thread rack 51 for the quilter 12. The clamp mechanism 52 includes a bar clamp 55 formed of two bars that extend transversely across the width of the web 30 on opposite sides of the path 43 to clamp the tail or trailing edge of the ticking of the last quilt to be made from the material from the roll 41 at the quilting station 11. When the point on the web 30 from the roll 41 at which a splice is to be made, as determined by the controller 20 from information from the panel cutter 24, drive assembly 17 and encoder 26, is present adjacent the clamp 55, the controller 20 momentarily pauses the operation of the drive assembly 17 and stitching mechanism 13 so that the clamp 55 can be actuated to clamp the web 30 and transfer the web 30 to a cutoff position via a track **55*a*. The cut-off mechanism 53 includes a conventional transverse cutoff knife 56 and is normally parked at one side of the path 43 adjacent an edge of the web 30**.

In the embodiment of FIG. 1, when the web 30 has been cut from the roll 41, the operator may manually rewind the roll 41 in the trough 44. To pivot the H-frame of transfer arm 48 through 180° to exchange the bins 44 and 46, and thus replace 41 at the feed position 42 with the roll 45, a motor 57 is preferably provided that operates in response to a signal from the controller 20. In the alternative or in addition, manual rotation of the H-frame transfer arm 48 can be made by provision of a hand wheel **57*a*, as schematically shown in FIG. 2. When the rolls 41 and 45 have been exchanged, the operator can unwind the roll 45 for splicing to the training edge of the downstream cut portion of the web 30. To unroll the roll 45 the clamping mechanism 52 further is provided with a pair of clamps 58 at the sides of the path 43 to grip the corners of the leading edge of the facing material from the roll 45, as illustrated in FIG. 3. The two clamps 58 are preferably moveable in tracks 59 to guide the leading edge of the material from the roll 45 to a position adjacent the clamped trailing edge of the downstream portion of the web 30. A further clamp 54***a* may be provided in the form of a pair of transverse bars similar to those of the clamp 55, either on the frame 51 at the splicing station 50 or on the stitching mechanism 54, to clamp the leading edge of the material from roll 45 across its width to facilitate its attachment to the trailing edge of the web 30. Such additional clamp 54*a* and the clamp 58 hold the leading edge adjacent the trailing edge of web 30 as held by the clamp 55.

The stitching mechanism 54 is preferably a bag closure type chain stitching device that is moveable vertically on the frame 51 from a rest position at the top of the frame 51 into a stitching position in which the edges of the facing material to be joined are between the stitching elements of the stitching mechanism 54. When in the stitching position, the stitching mechanism moves transversely across the path 43 to stitch the two edges of the facing material web together. When the splice has been made, the stitching mechanism 54 as well as the clamps 55 and 58 of the clamping mechanism 52 are deactivated to return to their original positions.

Other configurations of the splicing station 50 may be employed to stitch or otherwise attach the leading edge of the facing material either to the trailing edge of the facing material web 30 or otherwise to the web of fabric 16, to which the facing material from the new roll 45 may be attached directly.

Referring again to FIG. 1, the facing material supply 33 includes a rack or storage area, which is in the illustrated embodiment in a carrousel type storage unit 60, that contains a plurality of storage locations 61 to hold a plurality of rolls of ticking or facing material. The number of such locations may, depending on the needs of the user, be a small number of locations 61, illustrated as nine in the drawings, or from fifty to one hundred or more. The storage locations 61 may be in the form of fixed locations such as the storage compartments, shelves or racks of a type used in a warehousing system, or may be moveable holders in the form of roll shaft supports or troughs similar to the bins or cradles 44 and 46. With either moveable or stationery storage locations 61, a roll retrieval mechanism is preferably provided in the supply 33 to move any selected one of a plurality of rolls 64 from the storage locations 61 to the feed position 42 at the feeding station 40.

In the illustrated embodiment, a retrieval mechanism 65 is provided that includes an endless conveyor 66 that includes a pair of chains 67 supported on a frame 68 that stands on each side of the quilting machine 10, as illustrated in FIG. 2. The bins 62 are each supported on shafts 69 at opposite ends thereof each pivotally connected to one of the chains 67 to extend horizontally between the chains and hang downwardly therefrom much like the chairs of a ferris wheel. The chains 67 are driven in synchronism by a drive motor 71 through a transmission system 72 that extends across the frame 68 to engage the chains 67 on both sides of the machine 10.

In the embodiment illustrated in detail in FIG. 2, the motor 71 is connected to the controller 20 so as to be responsive to a signal from the controller 20 to index the conveyor 66 to bring any selected roll 64 of facing material to a transfer position to be transferred to and from the feeding position 42. The indexing may be made in response to signals from the controller 20 utilizing information in a memory provided therein to keep track of which rolls 64 are present in which of the bins 62 and the locations 61, or positions therebetween, occupied by the bins 62. In the alternative, the controller 20 may rely on information from one or more sensors, such as sensor 74, located adjacent the paths of the bins 62, to read machine readable indicia, such as bar codes 75, on the bins 62, or preferably on the rolls 64, to identify or verify the location of the selected roll.

The conveyor 66 preferably brings the bin 62 carrying the selected one of the rolls 64 to the first of two transfer positions 77 and 78. The transfer position 77 is located above the standby roll position or hand off position, which is the position of the bin 46 in FIG. 1. In the position 77, a roll 64 can be transferred to the bin 46 of the transfer mechanism 47 at least partially assisted by gravity. The transfer position 78 is located below the standby roll position or hand off position of the transfer mechanism 47 so that a roll may be replaced in a bin 64 at least partially assisted by gravity.

As illustrated in FIG. 2, an unloading cylinder 81 is provided, each pivotally mounted at its base 82 to one side of the frame 78. The cylinders 81 each rest against a stop 83 on the frame 78 to maintain the inclination of a piston rod output 84 of the cylinder 81 at a preferred inclination so that a V-shaped element 85 on the tip of the rod 84 will align with and engage a cylindrical post 86 projecting from the side of the bin 62 when that bin is located at the transfer position 77. When energized, the cylinders 81 extend their piston rods 84 to engage the posts 86 provided on each side of each roll holder 62 to rotate the bin 90° on its shaft, as illustrated, to dump the roll 64 contained therein toward the bin at the hand-off position of the transfer mechanism 47.

Similarly, a cylinder 91 is provided, each pivotally mounted at its base 92 to one side of the frame 78 adjacent the hand-off position of the transfer mechanism 47. The cylinders 91 each rest against a spring or resilient stop 93 on the frame 78 to maintain the inclination of a piston rod output 94 thereof at a preferred inclination so that a V-shaped element 95 on the tip thereof will align with and engage a cylindrical post 96 projecting from the side of the bin 44 or 46 that is located at the hand-off position. When energized, the cylinders 91 extend their piston rods 94 to engage the posts 96 provided on each side of the bins 44 and 46 with the V-shaped elements 95 to rotate the bin 90° on its shaft, as illustrated, to dump the roll being replaced, for example the roll 41, into the trough 62 located at the lower transfer position 78. The controller 20 keeps track of the location of the roll 41 being returned to the storage unit 60, and may cause the conveyor 66 to be indexed to bring the same bin 62 to which the roll 41 had been previously assigned to the position 78 or may bring any empty bin 62 to the transfer position 78 and record in its memory that the roll 41 is being placed there. Alternatively or in addition, information from the sensor 74 can provide verification or identification of the roll in the bin.

Figure 5:
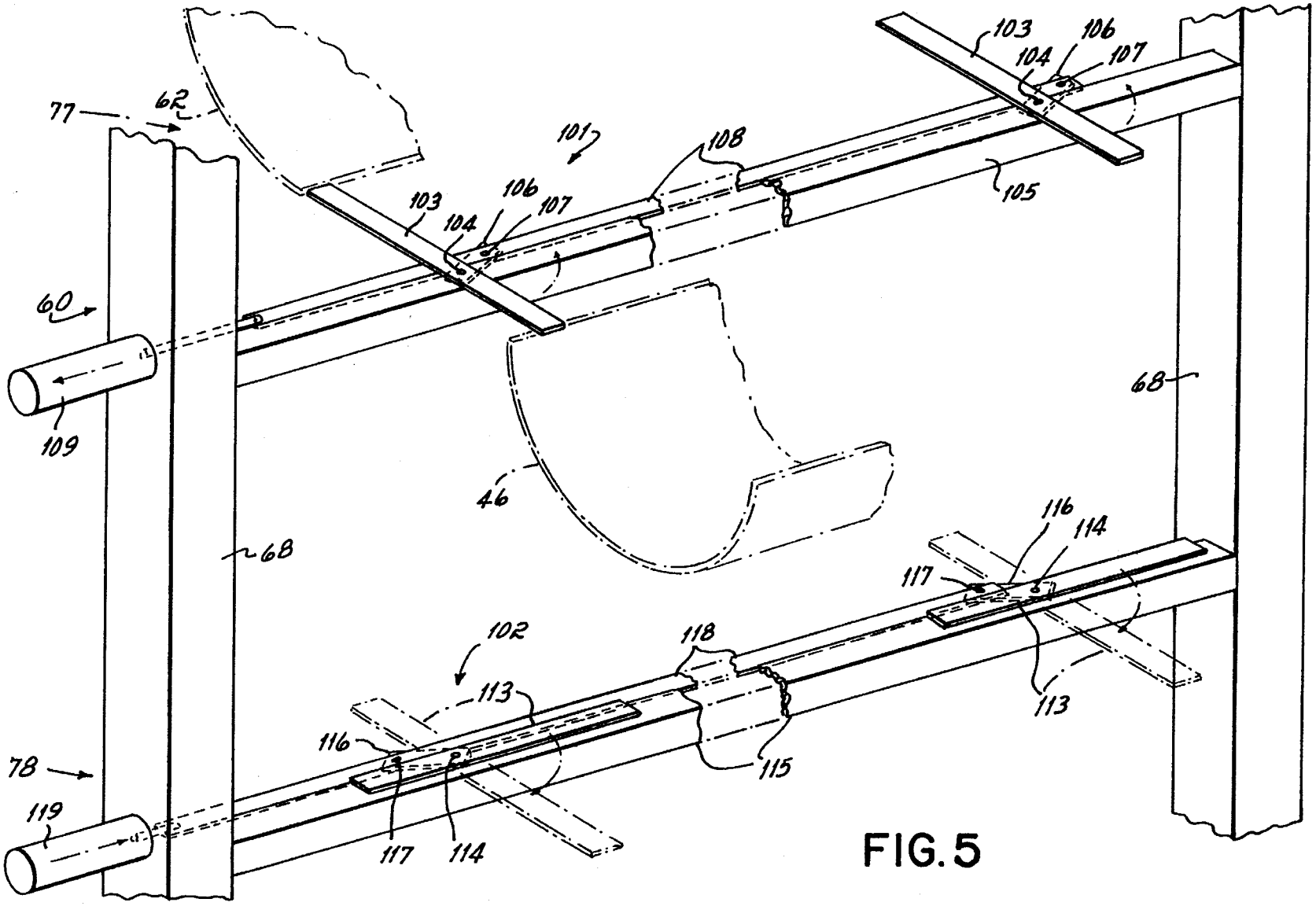
FIG. 5 is an isometric drawing of a portion of the facing material supply of FIG. 2.

To guide the rolls 64 being transferred from and to the bins 62 at the respective transfer positions 77 and 78, retractable guide assemblies 101 and 102 are respectively provided, as illustrated in FIG. 5. In FIG. 5, guide assembly 101 is shown having a plurality of, for example five, guide blades 103 pivotally connected by pivot pins 104 to a cross member 105 that extends between the sides of the frame 68 at the upper transfer station 77. Rigidly fastened to each of the blades 103 adjacent the connection point of the pins 104 are lever arms 106, which are pivotally linked at their remote ends by pins 107 to an actuator rod 108 that is reciprocatably driven in response to a signal from the controller 20 by a pneumatic cylinder 109 fixed to the frame 68. When the cylinder 109 is actuated, the blades 103, which are normally at rest parallel to and lying against the cross bar 105, are pivoted by movement of the rods 108, through the linkage of the lever arms 106, into a position generally perpendicular to the cross bar 105. In this perpendicular position, the blades 103 extend from the pivot pins 104 to the near top edge of the bin 46 on the transfer mechanism 47, and in the opposite direction to the approximate center of the bottom of the bin 62 at the transfer position 77. So oriented, when the bin 62 at position 77 is tipped by actuation of the cylinder 81, a continuous ramp is provided by the set of blades 103 on which the roll 64 from the bin 62 at the transfer station 77 can roll into the bin 46 of the transfer mechanism 47.

Similarly, guide assembly 102 is shown adjacent the lower transfer station 78 as having a similar plurality of, for example five, guide blades 113 pivotally connected by pivot pins 114 to a lower cross member 115 that also extends between the sides of the frame 68 at the upper transfer station 77 below the cross member 105. Rigidly fastened to each of the blades 113 adjacent the connection point of the pins 114 are lever arms 116, which are pivotally linked at their remote ends by pins 117 to an actuator rod 118 that is reciprocatably driven in response to a signal from the controller 20, by a pneumatic cylinder 119 fixed to frame 68. When the cylinder 119 is actuated, the blades 113, which are normally at rest parallel to and lying against the cross bar 115, are pivoted by movement of the rods 118, through the linkage of the lever arms 116, into a position generally perpendicular to the cross bar 115. In this perpendicular position, the blades 113 extend from the pivot pins 114 to the near top edge of the bin 62 at the lower transfer position 78, and in the opposite direction to the approximate center of the bottom of the bin 44 at the hand off or standby position of the transfer mechanism 47. (See phantom rendering in FIG. 2) So oriented, when the bin 44, for example, is tipped by actuation of the cylinder 91, a continuous ramp is provided by the set of blades 113 on which the roll 41, for example, can be returned to a bin 62 at the transfer station 78.

With the embodiment of the ticking or facing material supply 33 illustrated in FIG. 2, the moveable bins 62 and conveyor 66 combined with the transfer mechanism 47 function as a retrieval mechanism that moves any selected roll between a storage location 61 and the feeding position 42, under control of the programmed controller 20, so that the proper ticking is provided for the corresponding quilt to be quilted at the quilting station 11 by a corresponding pattern from the controller program and batch data input thereto.

Where a large number of rolls 64 must be available on line for use with the machine 10, a warehouse arrangement of fixed storage locations 61 may be preferable to provide for the rolls. With such a storage unit, the retrieval system preferably includes roll handling devices for retrieving the ticking rolls from the fixed storage compartments under the control of the controller 20. In such case, as with the other control functions described above, the controller 20 may communicate with dedicated sub-system controllers such as may be provided with such a roll handling device. In this way, any of a variety of available storage and retrieval systems may be utilized or adapted for use in the machine 10. In addition, the functions of the controller 20, described herein, may be distributed among programmed logic controlling, a main controller, a main PC or one or more other microprocessor based computers.

Figure 4A:
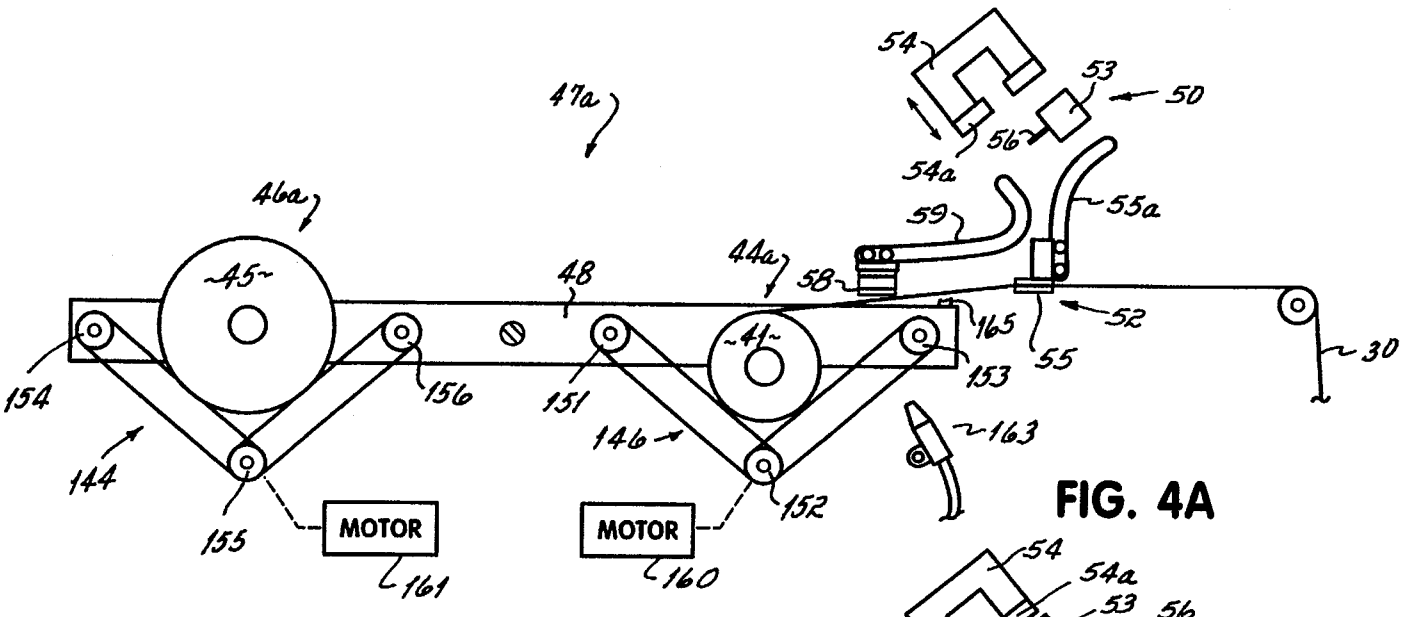
FIGS. 4A–4D are a sequence of views illustrating an operating sequence of a transfer mechanism of an alternative infeed station to that of the embodiment of FIG. 1.

For fully automated retrieval and replacement of ticking rolls 64, a alternative form of transfer mechanism **47*a* is provided, which differs from the transfer mechanism 47 as illustrated in FIGS. 4A–4D. Referring first to FIG. 4A, the transfer mechanism 47*a* includes the H-frame lever arm 48 on which are pivotally hung, in ferris wheel chair fashion, bin 44*a* which holds the ticking roll 41, as described above, and bin 46*a*, which holds the next replacement roll 45. The bins 44*a* and 46*a* may be provided with the same semi-circular end plates as to the bins 44 and 46 described above, pivotally hung on the shafts 49 on the arm 48, as illustrated in FIG. 2, but eliminated for simplicity from FIGS. 4A–4D. With the bins 44*a* and 46*a*, however, instead of the semi-cylindrical troughs with low friction interior surfaces, there are provided an interleaved V-shaped arrangement of belts 144 and 146, encircling sprocket wheels 151–153 and 154–156, respectively, mounted on horizontal shafts extending between the end plates of the bins. The center wheels on the center shafts 152 and 155 of the respective bins 44*a* and 46*a* are common to upstream and downstream flights of the belts 144 and 146 and are driven by separately bidirectionally controllable motors 160 and 161, respectively. The flights of belts are preferably each formed of a spaced plurality of belts. The bins 44*a* and 46*a*, with their motor driven V-shaped belt lined troughs provide for the automatic unwinding and rewinding of the rolls, for example rolls 41 and 45, to provide for fully automated ticking roll changes and splicing in response to signals from the controller 20 programmed to produce a sequence of quilts. The bins 44*a* and 46*a*** of this embodiment employ fabric web roll handling and unwinding technology used in the textile filed for devices called spreaders such as those manufactured under the trademark Bullmer Quick Change Magazine Cradle Feed Spreaders distributed by Singer Industrial Sewing Products of Murfreesboro, Tenn.

Such cradle feed spreaders may be adapted as shown diagrammatically in FIG. 4A, where the roll 41 is shown feeding the web 30 of facing material, resting in trough **44*a* in the feeding position 42, with the roll 45 resting in the trough 46*a* in the standby position. When the web 30 is being fed to the quilting station 11, there is tension imparted to the web 30 to pull it from the roll 41, and at such time as this is occurring the wheels 151–153 are free to rotate as the belts 144 move with the rotation of the roll 41. When the controller 20 determines that a splice point is present in the web 30 immediately upstream of clamp 55, the web 30 is stopped and clamp 55 closes to grip the web 30. The clamp 55 then moves along the track 55*a* to move the web 30 to the position shown in FIG. 4B and the cutting mechanism 53 is actuated to transversely cut the web 30 adjacent the clamp 55**.

Figure 4B:
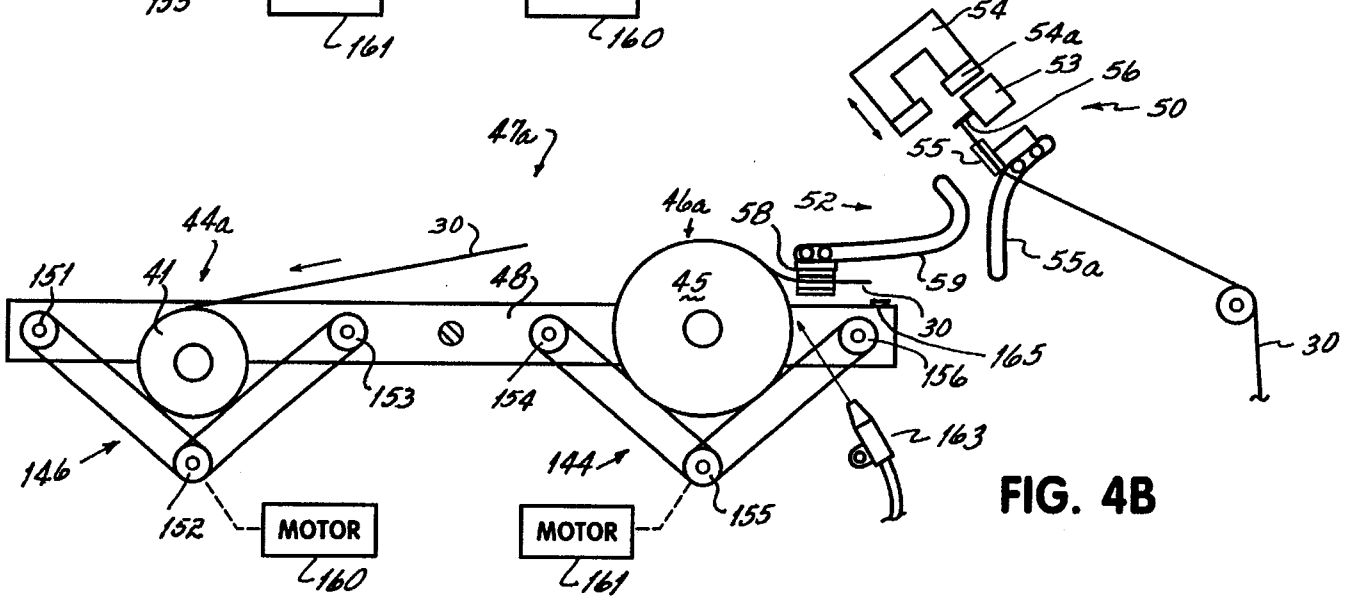
Figure 4C:
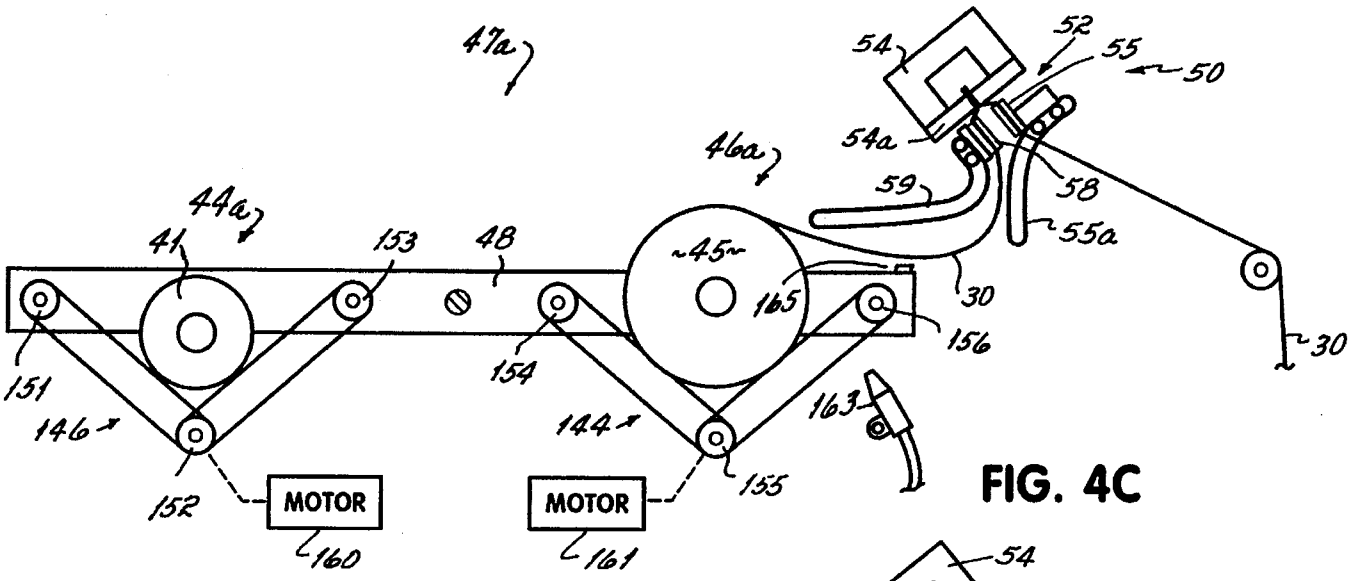
Figure 4D:
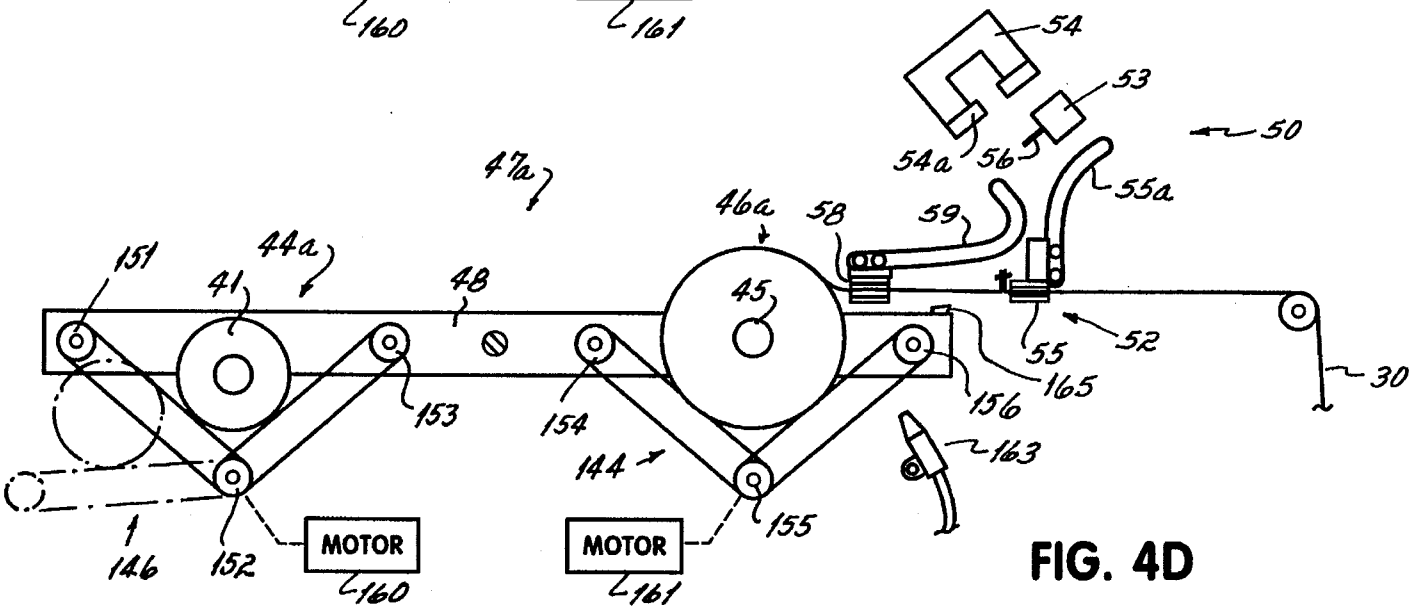

When the web 30 has been cut, the motor 57 (FIG. 1) is activated by a signal from the controller 20 to rotate the H-frame of the transfer arm 48 through 180°, to the position shown in FIG. 4B, bring the trough **44*a* containing the roll 41 to the hand-off position, where the cut off portion of the web 30 can be rewound onto the roll 41 by actuation of a motor 160 connected to the shaft of the wheels 152. When the trough 46*a* has arrived at the feeding position 42, a motor 161 on the shaft of the wheels 155 is actuated to rotate the roll 45. Simultaneously with the actuation of the motor 161, a pivotally mounted air jet 163 is actuated to facilitate the separation of the leading edge of the material on the roll 45 from the roll. When this leading edge is detected by a sensor 165 adjacent the clamps 58, the controller 20 is signaled and clamps 58 are actuated to close on and clamp this leading edge. Then the clamps 58 are moved along a track by an actuator (not shown) under a signal from the controller 20 to pull the leading edge to adjacent the cut trailing edge held by the clamp 55, as illustrated in FIG. 4C. At this point, the stitching mechanism 54 is actuated to stitch the leading and trailing edges together to reform the web 30 using the facing material from the roll 45. Then the clamps 55 and 58 are released and the web 30 is again tensioned and fed by the feed rollers 18 to the quilting station 11. With this embodiment, instead of rotating the bin 46***a* to dump the roll 41 back to the storage unit, the upstream flights 144 or 146 of the belts 146 may be made to pivot down to form a ramp on which the roll 41 may roll onto the blades 113 (FIG. 4D).

From the above description of the preferred embodiments of the invention, it will be apparent to those skilled in the art that changes and additions to the method and apparatus can be made without departing from the principles of the present invention. Accordingly, the following is claimed:

What is claimed is:

1. A quilting machine comprising:

a quilting station including a stitching mechanism operative to quilt a web of fabric extending through the quilting station; and a facing material supply including a storage unit having a plurality of supports each configured to hold a web of facing material, an infeed station positioned upstream of the quilting station such that a web of facing material is extendable therefrom along a path to the quilting station, and a retrieval mechanism operable to direct a selected web of facing material from the storage unit to the infeed station.

2. The quilting machine of claim 1 further comprising:

a cutoff mechanism positioned along the path; and an attaching mechanism positioned along the path between the cutoff mechanism and the quilting station.

3. The quilting machine of claim 2 further comprising:

a clamping element positioned along the path; and a controller programmed to determine a facing material splicing position along the web of fabric; to actuate the cutting mechanism to cut a trailing edge of a first web of facing material at the splicing position, to actuate the retrieval mechanism to replace the first web of facing material with a second web of facing material at the infeed station, and to actuate the attaching mechanism to connect a leading edge of the second web to the web of fabric adjacent the trailing edge of the first web.

4. The quilting machine of claim 1 wherein:

the retrieval mechanism includes a conveyor at the storage unit, the conveyor including a pair of endless bands lying in parallel vertical planes spaced on opposite sides of the storage unit, each of the opposite ends of the supports being pivotally connected to one of the bands to extend horizontally therebetween, the conveyor being indexable in response to a control signal to bring a selected one of the supports to a position at the infeed station.

5. The quilting machine of claim 1 wherein:

the retrieval mechanism includes a conveyor at the storage unit having the supports connected thereto and arranged to move a web of a selected facing material to a first transfer position adjacent the infeed station and to move a web of a previously selected facing material from a second transfer position adjacent the infeed station.

6. The quilting machine of claim 5 wherein:

the conveyor includes a pair of endless bands lying in parallel vertical planes spaced on opposite sides of the storage unit, each of the opposite ends of the supports being pivotally connected to one of the bands to extend horizontally therebetween, the conveyor being indexable in response to a control signal to bring a selected one of the supports to a position at the infeed station.

7. The quilting machine of claim 5 wherein:

the retrieval mechanism further includes a transfer arm at the infeed station having a first and second support connected thereto and arranged such that the first support moves the web of the selected facing material from the conveyor at the first transfer position to a feed position and the second support moves the web of previously selected facing material from the feed position to the second transfer position.

8. The quilting machine of claim 7 wherein:

the transfer arm is pivotable to alternatively exchange the first and second supports between the feed position and a hand off position at which webs are moved to and from the transfer positions at least in part by gravitational force; and the first transfer position being above the hand-off position and the second transfer position being below the hand-off position.

9. The quilting machine of claim 8 wherein:

each of the supports includes a bin-shaped cradle adapted to hold a rolled web of the facing material therein, the bin-shaped cradles of the first and second supports having an interior surface of sufficiently low friction to permit a web therein to be pulled and unrolled therefrom when at the feeding position.

10. The quilting machine of claim 1 further comprising:

a controller having program means for controlling the operation of the quilting station in the formation of quilted products, for selecting the facing material for each quilted product, and for controlling the operation of the retrieval mechanism to direct the selected web from the storage unit to a feed position at the upstream end of the path.

11. The quilting machine of claim 1 wherein:

the retrieval mechanism is operable to move the selected web from a storage position in the storage unit to a feed position at the infeed station.

12. The quilting machine of claim 11 wherein:

the retrieval mechanism includes a conveyor operable to move supports of the storage unit to a transfer position, and a transfer device at the infeed station operable to move a web from the transfer position to the feed position.

13. The quilting machine of claim 12 wherein:

the transfer device includes a transfer mechanism at the infeed station operable to move a web between a hand-off position and the feed position, and a hand-off mechanism operable to move webs between the transfer position and the hand-off position.

14. The quilting machine of claim 13 wherein:

the transfer mechanism has at least two transfer holders thereon and is moveable to simultaneously position one of the transfer holders at the hand-off position and one of the transfer holders at the feed position.

15. The quilting machine of claim 14 wherein:

each of the holders includes a bin-shaped support adapted to cradle a rolled web of the facing material therein, the bin-shaped support having a sufficiently low friction interior to permit the unrolling of the web therefrom.

16. The quilting machine of claim 1 wherein:

each of the holders is configured to support a rolled web of the facing material.

17. The quilting machine of claim 16 wherein:

each of the holders includes a bin-shaped support adapted to cradle a rolled web of the facing material therein and has a sufficiently low friction interior to permit the unrolling of the web therefrom.

18. The quilting machine of claim 1 wherein:

the facing material infeed station includes a bin-shaped support adapted to cradle a rolled web of the facing material therein with an upstream end thereof extending through the quilting station, the support having a sufficiently low friction interior to permit the unrolling of the web therefrom.

19. A quilting machine for sequentially forming quilts from a multiple layered web of fabric formed of a web of facing material and one or more webs of backing and filler material, the machine comprising:

a quilting station having a stitching mechanism operable to sew the webs of facing material and of backing and filler material together in stitched patterns, in response to a pattern control signal, to form a sequence of quilts when the web of fabric is guided through the quilting station;

a backing and filler material supply station upstream of the quilting station;

a facing material supply station upstream of the quilting station, the facing material supply station including a plurality of holders, each configured to support a respective one of a plurality of webs of facing material;

the facing material supply station being operable in response to a selection signal to selectively move a selected one of the webs of facing material into position for feeding to the quilting station; and a controller having means programmed for controlling the operation of the machine in accordance with batch job data defining each quilt of the plurality to be sewn by the machine, the data including pattern identifying information and facing material identifying information respectively defining the pattern and material by which each quilt is to be made, the programmed means including means for generating the pattern control signal in accordance with the pattern identifying information and the facing material information selection signal in accordance with the facing material identifying information.

20. The quilting machine of claim 19 further comprising:

a splicing station located between the facing material supply station and the quilting station, the splicing station including:

a cutoff mechanism, operable in response to a signal from the controller to sever from a web thereof a previously fed facing material extending from the facing material supply station to the quilting station, and a fastening mechanism, operable in response to a signal from the controller to connect the selected facing material to the web of fabric.

21. The quilting machine of claim 20 wherein:

means for tracking the relative locations of the quilted patterns along the web of fabric and, in response thereto, calculating the locations of splice points between different types of facing material thereon; and the programmed means including means for generating a cutoff signal to the cutoff mechanism and a fastening signal to the fastening mechanism based on the splice point calculation.

22. The quilting machine of claim 21 further comprising:

the tracking means includes means for calculating the change in length of the facing material caused by the quilting performed at the quilting station, the calculating of the locations of the splice points being at least in part based on the calculated change in length caused by quilting.

23. A method of fabricating quilts from a multiple layered web of fabric formed of a facing material and of backing and filler material, the method comprising the steps of:

providing a quilting machine with a controller programmed to form a sequence of quilts each in accordance with a set of specifications;

inputing to the controller data pertaining to the specifications corresponding to each quilt of the plurality, the specifications including a corresponding designation of a facing material which each quilt is to include;

providing a magazine containing a plurality of webs of facing material, including each of the designated facing materials which each of the plurality of quilts is to include;

for each quilt of the plurality, selectively advancing from the magazine facing material of the corresponding designation, in response to signals from the controller; and forming quilts along the web of fabric with facing material, so advanced, of the corresponding designation, in accordance with the data of the specifications in response to signals from the controller.

24. The method of claim 23 wherein the advancing step includes the steps of:

in response to a control signal from the controller, retrieving a roll of the designated material from the magazine and placing the roll in a feed position; then feeding the fabric material from the retrieved roll onto the web of fabric.

25. The method of claim 23 wherein the advancing step includes the steps of:

in response to a control signal from the controller, indexing the magazine to bring a roll of the designated material toward a feed position; then feeding the fabric material from the retrieved roll onto the web of fabric.

26. The method of claim 23 wherein the advancing step includes the steps of:

in response to a control signal from the controller, exchanging a roll of the designated material from the magazine with a roll of facing material at a feed position; then feeding the designated fabric material from the roll thereof onto the web of fabric.

27. The method of claim 23 wherein the advancing step includes the steps of:

in response to a control signal from the controller, indexing the magazine to bring a roll of the designated material to a transfer position; then in response to a control signal from the controller, exchanging a roll of the designated material from the transfer position with a roll of facing material at a feed position; then feeding the designated fabric material from the roll thereof onto the web of fabric.

28. The method of claim 23 further comprising the step of:

tracking the positions along the web of fabric of the quilts being formed and coordinating, with the controller, the advancing of the facing material in accordance with the tracked positions.

29. The method of claim 28 wherein:

the coordinating step includes the step of calculating a splice point, relative to the web of fabric, between facing materials of different types; and the method further comprises the steps of:

cutting at the calculated splice point, in response to a signal from the controller, a first facing material extending between a roll thereof and the web of fabric, and attaching at the splice point a leading edge of a facing material of the designation corresponding to the next quilt to be quilted.

30. The method of claim 23 further comprising the steps of:

loading each of a plurality rolls of different types of facing material into compartments in the magazine;

providing a memory and storing therein information identifying the type of each roll of facing material and the corresponding compartment in the magazine into which it is loaded; and the advancing step includes the steps of reading, with the controller, the information from the memory and selectively advancing the material of the corresponding designation in accordance with the information.

31. The method of claim 23 further comprising the steps of:

loading each of a plurality rolls of different types of facing material into compartments in the magazine, each roll having machine readable indicia thereon containing information identifying the type of facing material thereon;

providing a memory and, as the rolls are loaded into the compartments, reading with a sensor and communicating to the controller the indicia thereon and storing into the memory the information identifying the type of each roll of facing material and the corresponding compartment in the magazine into which it is loaded; and the advancing step includes the steps of reading, with the controller, the information from the memory and selectively advancing the material of the corresponding designation in accordance with the information.

32. The method of claim 23 further comprising the steps of:

loading each of a plurality rolls of different types of facing material into compartments in the magazine, each roll having machine readable indicia thereon containing information identifying the type of facing material thereon; and the advancing step includes the steps of reading, with a sensor and communicating to the controller the indicia on the rolls in the compartments and advancing the material of the corresponding designation in accordance with information read from the indicia.

33. The method of claim 23 further comprising the steps of:

loading each of a plurality rolls of different types of facing material into compartments in the magazine;

providing a memory and storing therein information identifying the type of each roll of facing material and the corresponding compartment in the magazine into which it is loaded;

the advancing step includes the steps of reading, with the controller, the information from the memory and selectively advancing the material of the corresponding designation in accordance with the information by exchanging a roll of the designated material from the magazine with a roll of facing material at a feed position; and updating the information in the memory in accordance with the exchanging of the rolls.

* * * * *